US008973513B2

(12) United States Patent
Morrison

(10) Patent No.: US 8,973,513 B2
(45) Date of Patent: Mar. 10, 2015

(54) RECOVERING CAPSIZED WATERCRAFT INCORPORATING RAPID FILLING AND EMPTYING BALLAST SYSTEMS

(75) Inventor: Aidan Morrison, Coogee (AU)

(73) Assignee: Rubber Ducky IP Pty Ltd, Coogee (AU)

( * ) Notice: Subject to any disclaimer, the term of this patent is extended or adjusted under 35 U.S.C. 154(b) by 215 days.

(21) Appl. No.: 13/522,480

(22) PCT Filed: Jan. 17, 2011

(86) PCT No.: PCT/AU2011/000044
§ 371 (c)(1),
(2), (4) Date: Aug. 27, 2012

(87) PCT Pub. No.: WO2011/088499
PCT Pub. Date: Jul. 28, 2011

(65) Prior Publication Data

US 2012/0318184 A1 Dec. 20, 2012

(30) Foreign Application Priority Data

Jan. 20, 2010 (AU) ..... 2010900212

(51) Int. Cl.

| | |
|---|---|
| ***B63B 43/02*** | (2006.01) |
| ***B63B 43/06*** | (2006.01) |
| ***B63B 13/00*** | (2006.01) |
| ***B63C 7/00*** | (2006.01) |
| ***B63H 11/10*** | (2006.01) |
| ***B63H 11/107*** | (2006.01) |
| ***B63H 11/11*** | (2006.01) |
| ***B63H 11/113*** | (2006.01) |
| ***B63H 11/117*** | (2006.01) |
| *B63B 39/03* | (2006.01) |
| *B63H 11/00* | (2006.01) |

(52) U.S. Cl.

CPC ..... *B63H 11/107* (2013.01); *B63B 13/00* (2013.01); *B63B 39/03* (2013.01); *B63B 43/06* (2013.01); *B63C 7/003* (2013.01); *B63H 11/11* (2013.01); *B63H 2011/008* (2013.01)

USPC ..... 114/125; 440/40; 440/41; 440/43

(58) Field of Classification Search

CPC .... B63H 11/10; B63H 11/101; B63H 11/107; B63H 11/11; B63H 11/113; B63H 11/117; B63H 2011/008; B63B 39/03; B63B 39/08; B63B 43/02; B63B 43/06; B63B 13/00; B63C 7/003

USPC ..... 114/121, 125, 150, 151; 440/40–43

See application file for complete search history.

(56) References Cited

U.S. PATENT DOCUMENTS

| | | | | |
|---|---|---|---|---|
| 1,716,400 | A | 6/1929 | Weis | |
| 3,186,371 | A * | 6/1965 | Moore | 114/125 |

(Continued)

FOREIGN PATENT DOCUMENTS

| | | | |
|---|---|---|---|
| CH | 628581 | A5 * | 3/1982 |
| GB | 451995 | A | 8/1936 |
| JP | 05338588 | A * | 12/1993 |
| RU | 2111884 | C1 * | 5/1998 |

*Primary Examiner* — Ajay Vasudeva

(74) *Attorney, Agent, or Firm* — Seed IP Law Group PLLC

(57) ABSTRACT

A craft including a body having a front end, a rear end, two sides miming between said ends, and an axis running generally from the rear end to the front end; and a water displacement system operable to displace water to propel the craft across water and to displace water to cause the craft to rotate about said axis. The craft includes a ballast tank capable of being at least partially filled with ballast to change a position of a center of gravity of the craft to assist in rotation of the craft when capsized. The craft also includes a rapid filling and emptying system for a ballast system of a craft in addition to a water displacement system, wherein the rapid filling and emptying system includes at least one ballasting intake through which water is passed from the water displacement system into said ballast system; and at least one ballasting outlet through which the water displacement system draws water from the ballast system.

24 Claims, 13 Drawing Sheets

(56) References Cited

U.S. PATENT DOCUMENTS

| | | | | | |
|---|---|---|---|---|---|
| 3,727,573 | A | * | 4/1973 | Prohaska | 114/122 |
| 3,827,389 | A | * | 8/1974 | Kureth | 440/42 |
| 4,227,474 | A | * | 10/1980 | Ullrich | 114/61.11 |
| 4,700,650 | A | | 10/1987 | Nishida | |
| 4,765,269 | A | * | 8/1988 | Fuller | 114/61.11 |
| 4,919,067 | A | * | 4/1990 | Wenstob et al. | 114/345 |
| 5,215,025 | A | * | 6/1993 | Talmor | 114/271 |
| 7,255,617 | B2 | | 8/2007 | Yokoya et al. | |
| 7,892,053 | B2 | | 2/2011 | St-Pierre et al. | |

* cited by examiner

RECOVERING CAPSIZED WATERCRAFT INCORPORATING RAPID FILLING AND EMPTYING BALLAST SYSTEMS

BACKGROUND

1. Technical Field

The present invention relates to craft, in particular water craft, ballast systems and systems for the rapid filling and emptying of ballast systems.

2. Description of the Related Art

In many water borne activities, water crafts, such as jet boats and rescue craft, are used to move people and/or objects across the water. The agility and power of such smaller vessels make them attractive for water-sports enthusiasts and thrill-seekers, for example. However, they may be generally unsuitable for military use as they may not be adapted for long deployment, nor be adapted to cope with the various weather conditions prevalent at sea.

The speed at which smaller craft can travel makes them comparatively less stable than larger craft, such as navy frigates and destroyers, especially in rough water. As a craft increases its velocity, the chance it will capsize can increase. This is particularly the case for jet boats and other forms of speed boat, and the capsized craft can be very difficult to 'right'—return to an upright position—in order to continue moving.

Devices have been designed to improve the stability of the craft in the water, such as canting keels, which comprise a torpedo shaped ballast body at the tip of an aerofoil. The moment of the ballast body on the aerofoil is generally greater than that of the craft, and capsizing is thereby prevented. However, when travelling normally, the ballast is a deadweight which slows the craft, and such designs are generally impractical for use in faster boats, such as jet boats, as they reduce the speed and agility which make those craft attractive to use. Few practical designs are capable of preventing capsizing.

It is, therefore, generally desirable to provide a craft that is capable of righting.

Furthermore, it is generally desirable to overcome or ameliorate one or more of the abovementioned difficulties, or at least provide a useful alternative.

BRIEF SUMMARY

In accordance with the invention, there is provided a craft including:

a body having a front end, a rear end, two sides running between said ends, and an axis running generally from the rear end to the front end; and a water displacement system operable to displace water to propel the craft across water, and to displace water to cause the craft to rotate about axis.

Preferably, the water displacement system includes a drive propulsion system for displacing water to propel the craft across water and a rotate propulsion system for displacing water to cause the craft to rotate about said axis.

Preferably, the rotate propulsion system includes a plurality of water propulsion systems arranged to generate rotation of the craft about the axis when actuated simultaneously.

The present invention also provides a ballast system for a craft, including a ballast tank capable of being at least partially filled with ballast to change a position of a center of gravity of the craft to assist in rotation of the craft when capsized.

Preferably, the ballast tank includes a bottom ballast tank capable, when in use, of being at least partially filled to draw the center of gravity of the craft towards the bottom of the craft to assist in rotation of the craft when capsized.

Preferably, when in use, the bottom ballast tank occupies substantially all of the internal volume of the craft.

Preferably, the ballast system is adapted to reduce torque required to right fife craft by filling the ballast tank from one end of the craft only.

The present invention also provides a rapid filling and emptying system for a ballast system of a craft, which craft includes a water displacement system, wherein said rapid filling and emptying system includes:

at least one ballasting intake through which water is passed from the water displacement system into said ballast system; and at least one ballasting outlet through which said water displacement system draws water from the ballast system.

Preferably, the rapid filling and emptying system further includes a common orifice and a valve, wherein the ballasting outlet and ballasting inlet are configured to be coupled to the ballast system at the common orifice, and the valve is positionable to close one or both of the ballasting inlet and ballasting outlet.

Preferably, the rapid filling and emptying system is capable of filling the ballast system with sufficient ballast to substantially increase the mass of the craft and thereby lower the position of the craft in water, in order to substantially reduce the portion of the craft visible above water.

Preferably, the craft includes the ballast and rapid filling and emptying systems, and water drawn from the ballast system is used to propel the craft.

Advantageously, preferred embodiments allow a craft to right without assistance.

For ease of understanding, the description and Figures provided below will not show the ballast system and/or rapid filling and emptying system in isolation, but will instead show those systems when housed within a craft. However, the ballast system and/or rapid filling and emptying system may be incorporated into existing vessels and water craft as required. In addition, the mass system shown in the drawings forms part of the ballast system, though the purpose of the ballast system and the purpose of the mass system may be served by separate systems as appropriate.

The water displacement system will be hereinafter described as having a single "propulsion system". However, the water displacement system may be provided with separate propulsion systems, being a drive propulsion system and a rotate propulsion system, to respectively propel the craft across water and displace water in a manner which causes the craft to rotate about its axis. Furthermore, the description and Figures only show the water propulsion systems to be located at the rear end of the craft, however, it will be understood that water propulsion systems may also be located at positions intermediate the ends, closer to the center of gravity of the craft, for example.

BRIEF DESCRIPTION OF THE SEVERAL VIEWS OF THE DRAWINGS

Preferred embodiments of the present invention are hereafter described, by way of non-limiting example only, with reference to the accompanying drawings, in which.

DETAILED DESCRIPTION

Figure 1:
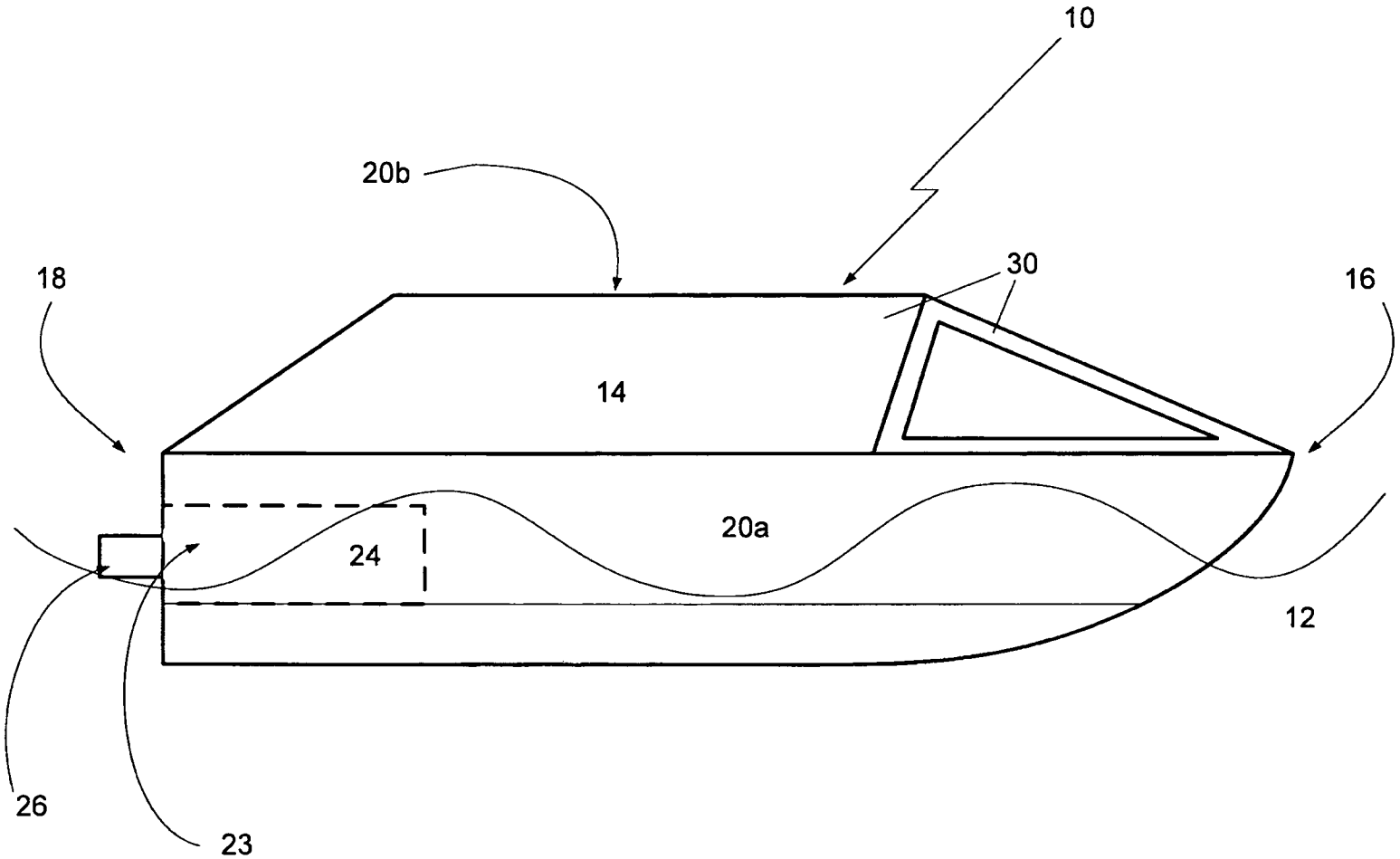
FIG. 1 is a plan view of a craft floating on water.

As used herein, to 'right' is to return from a capsized or overturned position to an upright position, without the aid of external devices or other vessels. A similar meaning also applies to related words such as "righting" and "rights".

Like reference numerals will be used herein to refer to similar features depicted in the various drawings.

Figure 2:
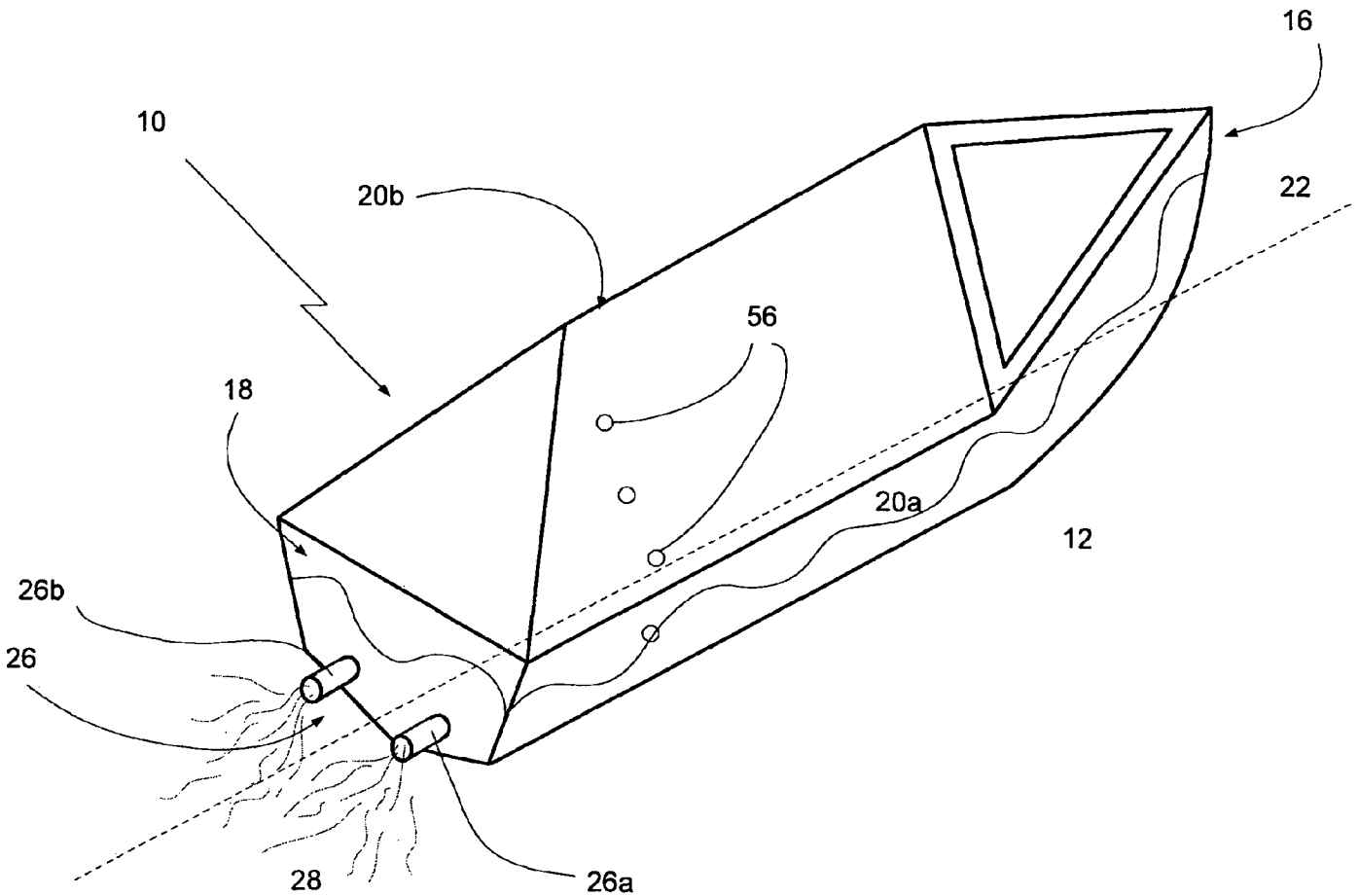
FIG. 2 is a perspective view of the craft of FIG. 1, when upright.
Figure 3:
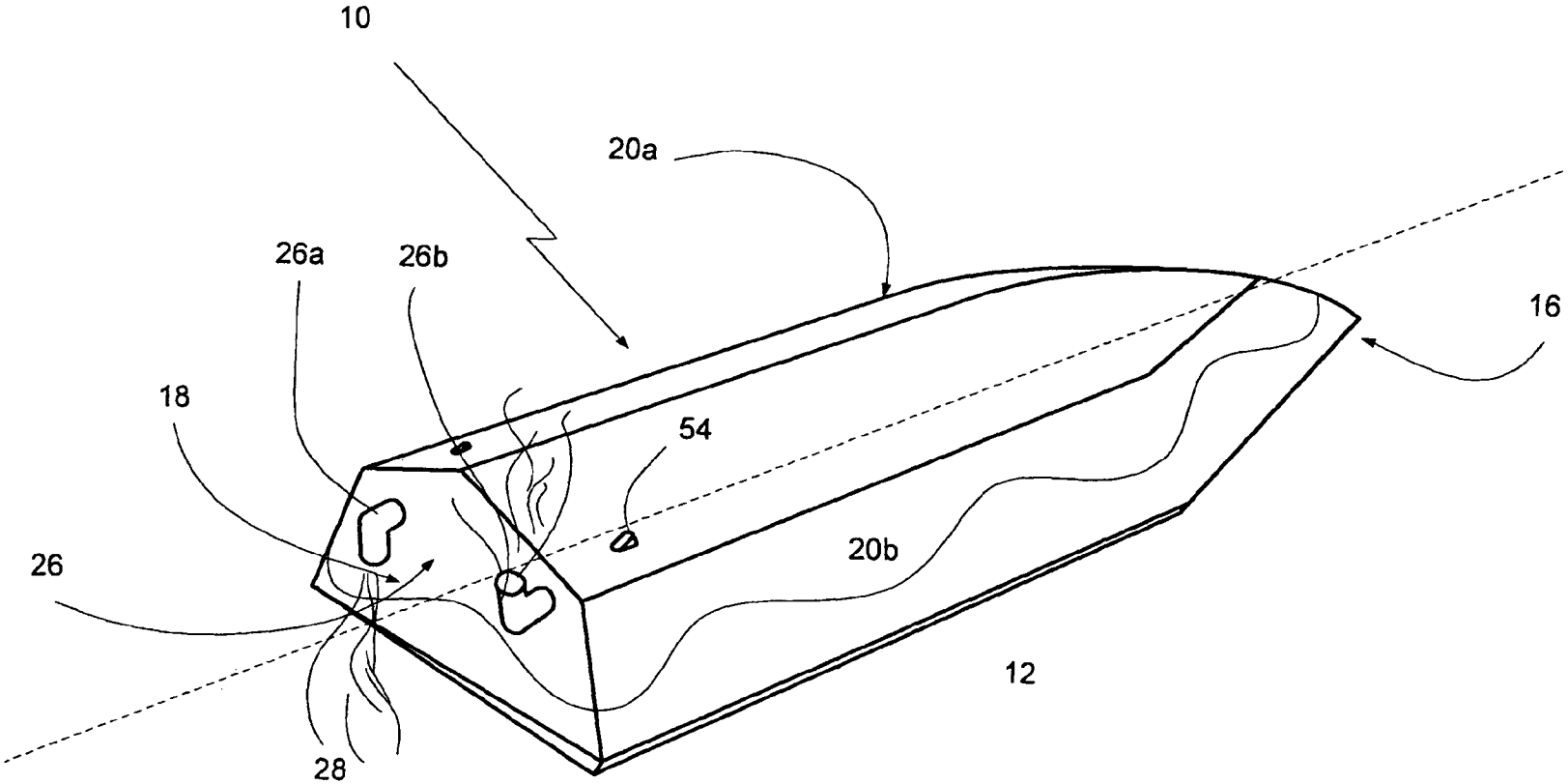
FIG. 3 is a perspective view of the craft of FIG. 1, when capsized.

The craft 10 shown in FIGS. 1 to 3 is used to propel an operator and/or items, such as cargo, across water 12. The craft 10 includes a body 14 having a front end 16 (the 'bow'), a rear end 18 (the 'stern'), and sides 20*a*, 20*b* running between the ends 16, 18. The body 14 is formed by a series of flat panels 30, coupled in a known manner (i.e., by welding), for minimizing the possibility that the craft 10 will be detected by radar. Similarly, all features of the body 14, such as the windscreen, should be formed so as to conform with the surface of the body 14 (i.e., not to incorporate distinct surface features). An axis 22, as shown in FIGS. 2 and 3, about which the craft 10 rolls during righting, is defined between the two ends 16, 18 and runs generally parallel with the sides 20*a*, 20*b* through the center of gravity (not shown) of the craft 10.

The craft 10 further comprises a water displacement system 23 coupled to said body 14 in a suitable manner, including a propulsion system 24, for propelling water 12 through the water displacement system 23, and a water propulsion system 26. The water propulsion system 26 is operable to displace water 12 to propel the craft 10 across water 12, and to displace water 12 to cause the craft 10 to rotate about its axis 22. Though the functions of propelling the craft 10 across water 12 and causing the craft 10 to rotate about its axis 22, may employ separate water propulsion systems 26, in the present case, the water propulsion system 26 is moveable between a drive position and a rotate position, as shown in FIGS. 2 and 3 respectively. The drive position is a normal operating condition in which the displaced water 28 propels the craft 10 across the water 12. The rotate position is a righting condition, in which the displaced water 28 causes the craft 10 to rotate about the axis 22. If the craft 10 capsizes, the water propulsion system 26 moves to the rotate position to assist in returning the craft 10 to an upright position.

The craft 10, as shown in FIG. 2, includes two water propulsion systems 26*a*, 26*b* each of which is in a drive position and is arranged closer to one side 20*a*, 20*b* than the other. Spacing the water propulsion systems 26*a*, 26*b* as shown provides stability, as the propulsive force is effectively distributed across the stern 18 of the craft. When in a drive position, the craft 10 and propulsive forces act in generally the same manner as for known speedboats and will, therefore, not be described herein in further detail.

When the water propulsion systems 26*a*, 26*b* move into respective rotate positions, as shown in FIG. 3, they work in unison to displace water 28 in a manner which provides an anticlockwise rotational force to the craft 10. The rotational force provided by the water propulsion systems 26*a*, 26*b* may be increased by increasing their flow rate or by positioning them further apart. Although not strictly necessary, the water propulsion systems 26*a*, 26*b* herein described are independently capable of supplying sufficient rotational force to cause rotation of the craft 10 about the axis 22.

Figure 4B:
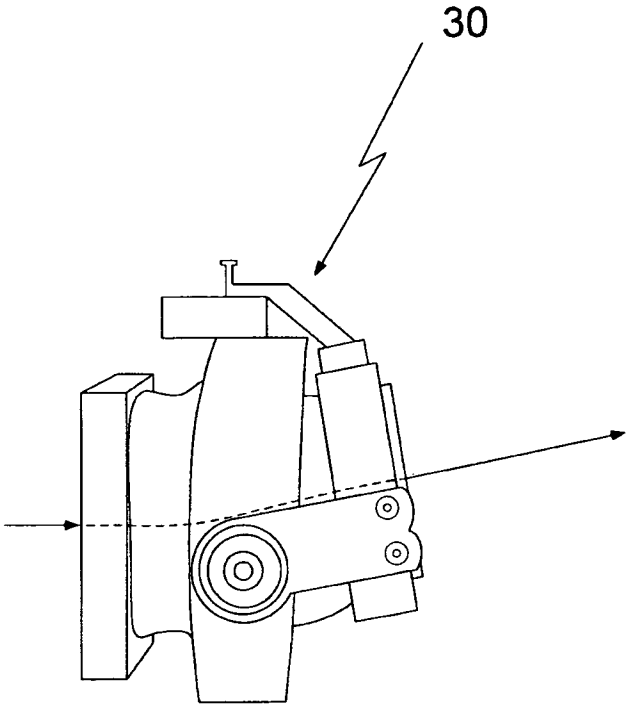
FIGS. 4A and 4B are plan views of a trim nozzle.
Figure 4A:
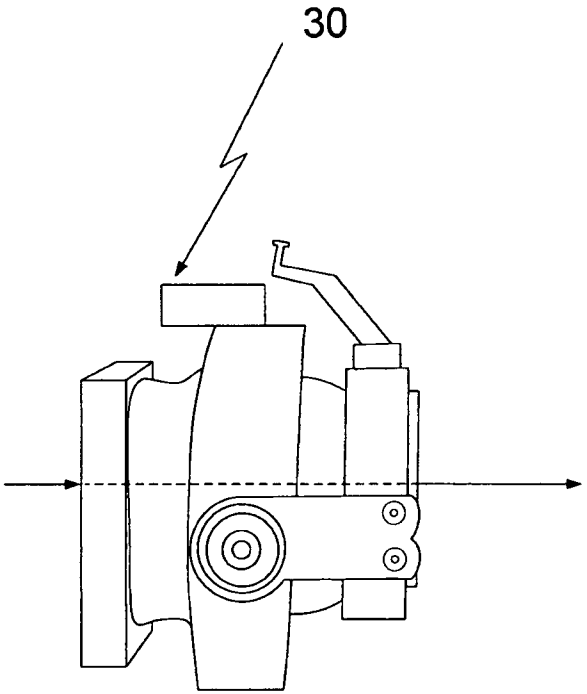

To move the water propulsion systems 26*a*, 26*b* from a drive position to a rotate position, each water propulsion system 26*a*, 26*b* may include a trim nozzle 30 which is pivotable between drive and rotate positions, as shown in FIGS. 4A and 4B respectively, in order to redirect thrust from the propulsion system 24. The stability of the craft 10 while rotating, when the water propulsion systems 26*a*, 26*b* are in the rotate position, will depend on the orientation of the trim nozzles 30. In particular, if the craft 10 is stationary and a trim nozzle 30 directs thrust directly towards the water 12, it may encourage the rear end 18 of the craft 10 to rotate and lift, which would move the line of action of the center of gravity towards the front end 16 of the craft 10, thereby forcing the front end 16 of the craft 10 towards/away from the water 12, hindering rotation and increasing the force required to right the craft 10. In such circumstances, if the trim nozzle 30 is adjusted so that some forward/reverse thrust is provided whilst rotating, it may cause the front end 16 of the craft 10 to remain level with the rear end 18, which can reduce the force required to right the craft 10. Alternatively, the water propulsion systems 26*a*, 26*b* may initially be positioned to provide forward momentum to the craft 10 and be, before that momentum is lost, repositioned to provide the desired rotational force. Alternatively, the outlets (i.e., trim nozzles 30) for the propulsion system 24, when in a rotate condition, may be placed nearer the center of gravity of the craft 10, thereby providing greater stability during rotation. Various trim nozzles 30 are disclosed in U.S. patent application Ser. No. 11/849,178, the entirety of which is incorporated herein-by reference. Furthermore, trim nozzle control systems are known and will, therefore, not be described herein in further detail.

Figure 5B:
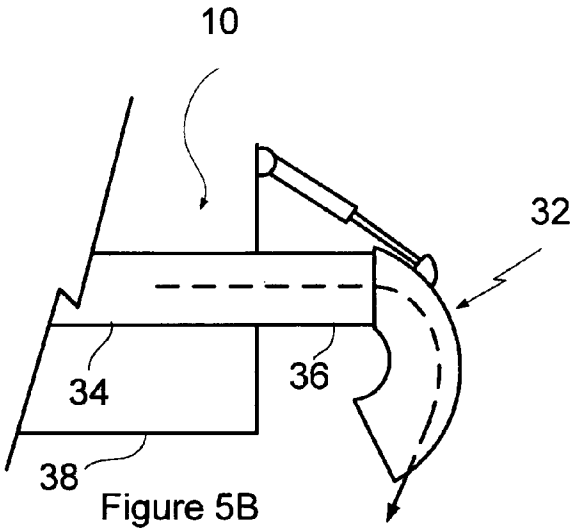
FIGS. 5A to 5D are partial plan views of a craft including jet outlet diverters.
Figure 5D:
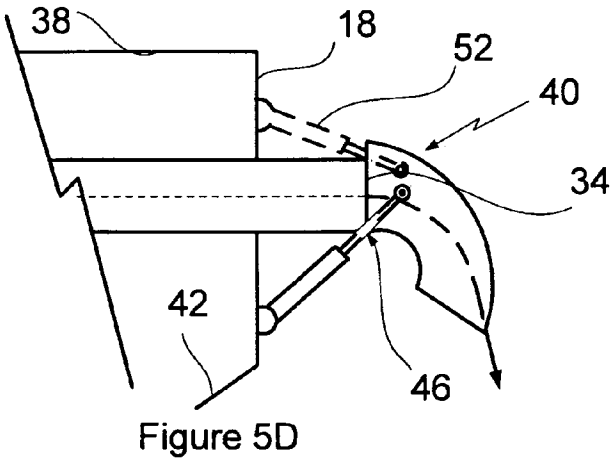
Figure 5A:
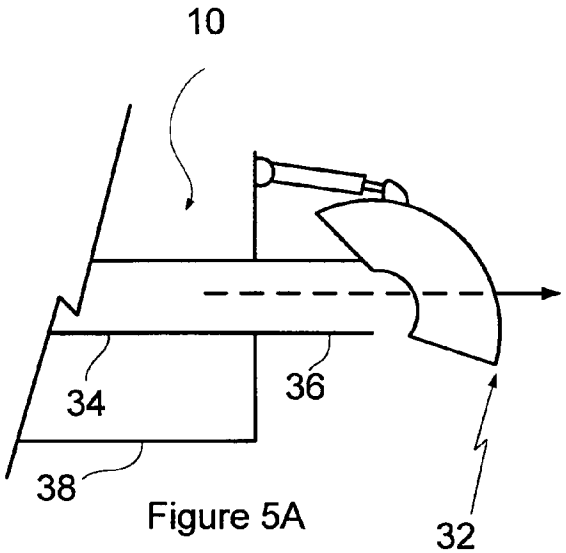
Figure 5C:
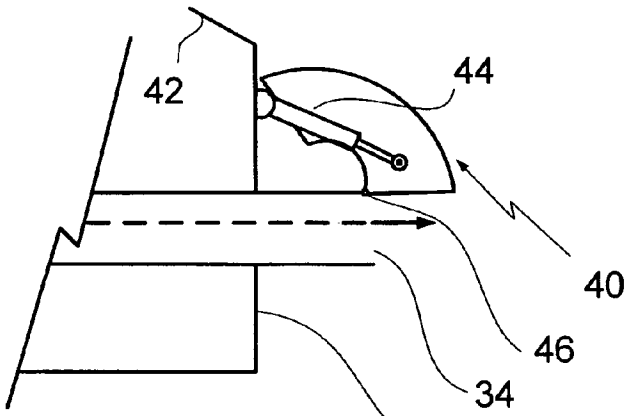

As an alternative to trim nozzles 30, the water propulsion systems 26*a*, 26*b* may include diverters 32 (also known as "buckets"), as shown in FIGS. 5A to 5D, which redirect flow from the jet outlets 34. A traditional diverter 32, as shown in FIGS. 5A and 5B, serves to redirect flow from a jet boat outlet nozzle 36 towards the bottom 38 of the craft 10, to allow the craft 10 to maneuver slowly and reverse. Such diverters 32 operate in a known way and will not be discussed herein in further detail. An altered diverter 40, as shown in FIGS. 5C and 5D, serves to direct flow towards the top 42 of the craft 10 (as shown in FIG. 1). If the craft 10 has capsized, the top 42 of the craft 10 will become submerged. Therefore, when the craft 10 has capsized, as shown in FIG. 5D, the altered diverter 40 will direct flow towards the water 12, so that the thrust will cause the craft 10 to rotate about the axis 22 (not shown).

The altered diverter 40 includes an hydraulic ram 44 coupled between the side of the diverter 40 and the stern 18 of the craft 10. By coupling the hydraulic ram 44 to the side of the diverter 40, rather than the top of the diverter 40 as shown in FIGS. 5A and 5B, the hydraulic ram 44 can move with the diverter 40, past the jet outlet 34 of the water propulsion system 26, without interfering with the flow through the jet outlet 34. Alternatively, the hydraulic ram 44 may be mounted on the inside curve of the diverter 40, for example, or at any other suitable location. The altered diverter 40 includes a hinge 46, providing a fixed pivot point between the altered diverter 40 and jet outlet 34. The hinge 46 allows the positioning of the altered diverter 40 to be set in a position in which the propulsion system 24 delivers optimum rotational force to the craft 10.

Figure 6:
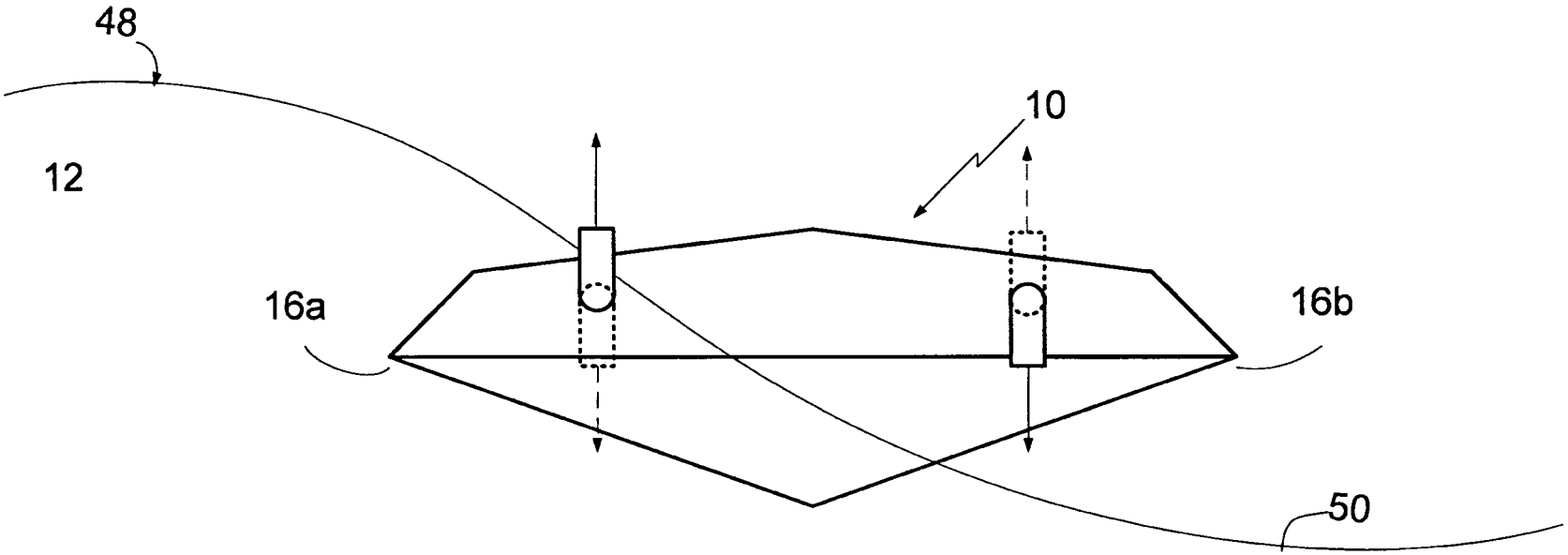
FIG. 6 is a rear view of a capsized craft in a wave.

The fixed nature of the hinge 46 ensures that the altered diverter 40 only redirects water from the jet outlet 34 towards the top 42 of the craft 10, and not towards the bottom 38. Therefore, the hinge 46 prevents the craft 10 from being able to rotate in both clockwise and anticlockwise, in order to right. This can be disadvantageous as conditions which may assist in righting rotation may instead serve to compete against that rotation. For example, as shown in FIG. 6, a wave 48 approaching the craft 10 from the side 20*a* (port side) creates a trough 50 on the side 20*b* (starboard side). Therefore, the wave 48 could assist in anticlockwise rotation of the craft 10. However, the water propulsion systems 26*a*, 26*b* are oriented to cause anticlockwise rotation of the craft 10 and the wave 48 thus competes against the rotational force imparted by the propulsion system 24. If the water propulsion systems 26*a*, 26*b* were oriented as shown by the broken line, the rotational force imparted by the propulsion system 24 would cooperate with the wave 48 and reduce the force required to right to craft 10.

As an alternative to the hinge 46, a second hydraulic ram 52 (shown by the broken line) may be used to position the diverter 40. This can allow the diverter 40 to direct flow towards either the top 42 or bottom 38 of the craft 10, thereby selectively rotating the craft 10 in either a clockwise or anticlockwise direction. In any event, control systems for trim nozzles 30, diverters 32, 40 and hydraulic rams 44, 52 are known and will not be described herein in further detail.

The propulsion system 24 will generally be a water jet system and will thus require water intakes 54 as shown in FIGS. 2 and 3. The craft 10 has primary water intakes 54 which are used when the craft 10 is upright. However, when the craft 10 capsizes or pitches heavily, these primary intakes 54 may no longer be in contact with the water 12. Consequently, the propulsion system 24 will not be able to supply thrust. Therefore, the craft 10, as shown in FIG. 2, includes at least one auxiliary intake 56 positioned on a side 20*a*, 20*b* or top 42 of the craft 10. In the embodiment shown, the craft 10 includes a plurality of auxiliary intakes 56 such that there is always at least one intake 54, 56 in contact with the water 12 and a continuous flow can be supplied to the propulsion system 24.

Figure 7:
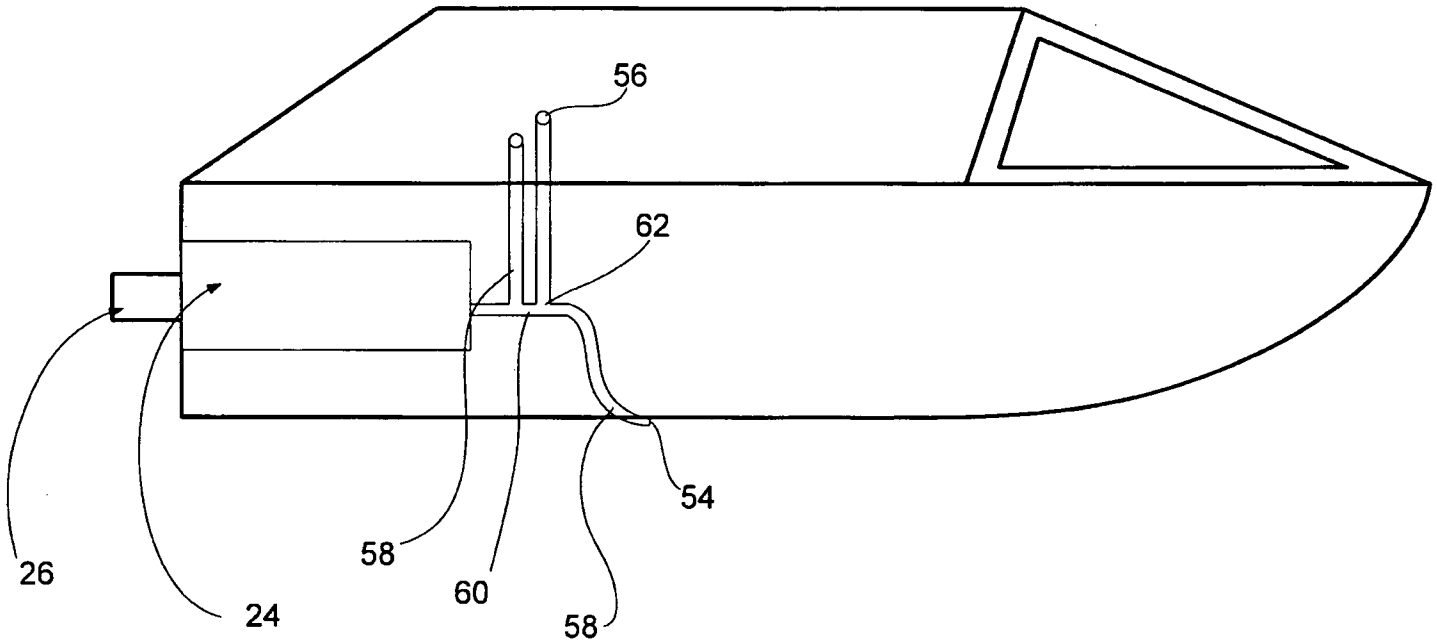
FIG. 7 is a cross-sectional view of the craft of FIG. 1.

Any of the intakes 54, 56 may have, for example, butterfly valves (not shown) mounted at their respective openings so that when a valve is closed (i.e., the respective intake 54, 56 is not in use) the surface of the valve remains flush with the surface of the body 14, thereby minimizing the possibility that the craft 10 will be detected by radar. In circumstances where a capsizing has occurred, or continuous sharp or evasive maneuvering is required, the valves may respond to the change in orientation of the craft 10, by automatically opening and closing to maintain flow through the propulsion system 24. This can be achieved by, for example, comparing accelerometer signals, which indicate the pitch of the craft 10, to the respective positions of the intakes 54, 46, to determine which intakes 54, 56 should be in contact with the water 12. A table listing the intakes which should be open/closed for any particular pitch sensed by the accelerometers, may also be consulted to determine which intakes should be open/closed. Alternatively, a laser sensor (not shown) may be inserted into one or more of the intake pipes 58, as shown in FIG. 7, to optically determine the density of the water in the pipe. As water 12 is more dense than air, the valve may close/open when the signal from the sensor indicates that the density is less/greater than a particular threshold level. Other density measuring instruments, flow meters and detection devices may be used to determine whether a particular valve should be opened/closed, to provide optimum flow to the propulsion system 24.

Figure 8B:
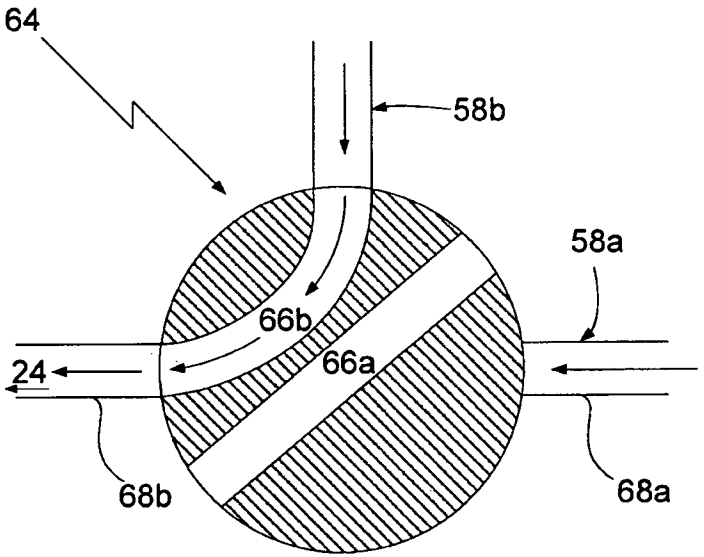
FIGS. 8A and 8B are cross-sectional views of a rotatable cylinder in various positions.
Figure 8A:
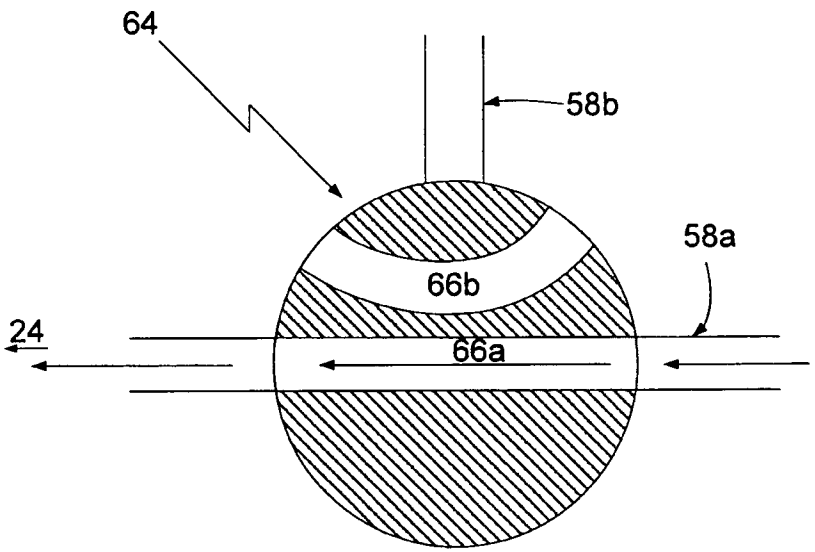

The intakes 54, 56 may all feed into common intake manifolds 60, or be otherwise connected as appropriate. At these piping joins 62, undesirable flow disturbances can occur due to changes in inner surface features of the pipes 58. To minimize these disturbances, further valves can be used to block one pipe and open another. For example, a rotatable cylinder 64, as shown in FIGS. 8A and 8B, having channels therethrough, can be installed at the joint of a standard intake pipe 58*a* and an auxiliary intake pipe 58*b*. The cylinder 64 is rotatable between a drive position, in which flow from the standard intake pipe 58*a* is delivered to the propulsion system 24, and a rotate position, in which flow from the auxiliary intake pipe 58*b* is delivered to the propulsion system 24.

The rotatable cylinder 64 includes two channels 66*a*, 66*b* which lie in a plane generally perpendicular to the axis of rotation of the rotatable cylinder 64. The first channel 66*a* is substantially straight and has the same diameter as the standard intake pipe 58*a*, which is preferably also the diameter of the auxiliary intake pipe 58*b*. In the drive position, as shown in FIG. 8A, the first channel 66*a* effectively replicates a portion of the standard intake pipe 58*a*, to join the upstream portion 68*a* of the standard intake pipe 58*a* to the downstream portion 68*b* with minimal flow disturbance. In this condition, the auxiliary intake pipe 58*b* cannot supply water 12 to the propulsion system 24. When in the rotate position, as shown in FIG. 8B, the second, curved, channel 66*b* is positioned such that it places the auxiliary intake pipe 58*b* in fluid communication with the downstream portion 68*b*. In this condition, the standard intake pipe 66*a* cannot supply water 12 to the propulsion system 24.

The rotatable cylinder 64 can be driven by any known means, such as a small standard motor, to rotate between drive and rotate positions, and the same principle of auxiliary intakes can be used for air supply to the engine.

Figure 9B:
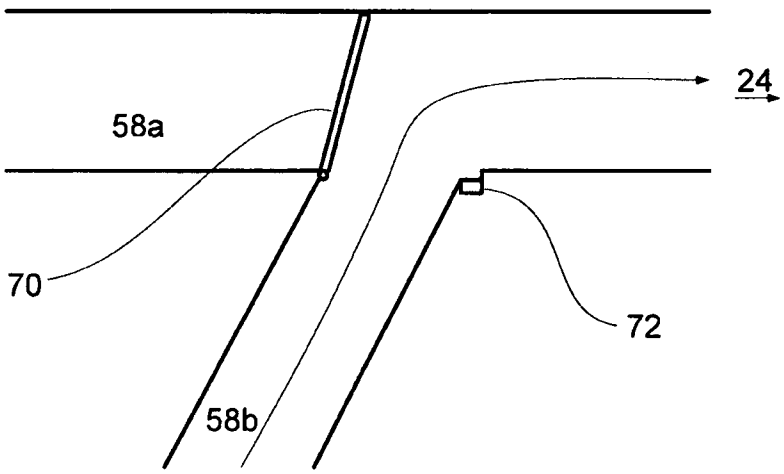
FIGS. 9A and 9B are cross-sectional views of a sprung flap in open and closed positions respectively.
Figure 9A:
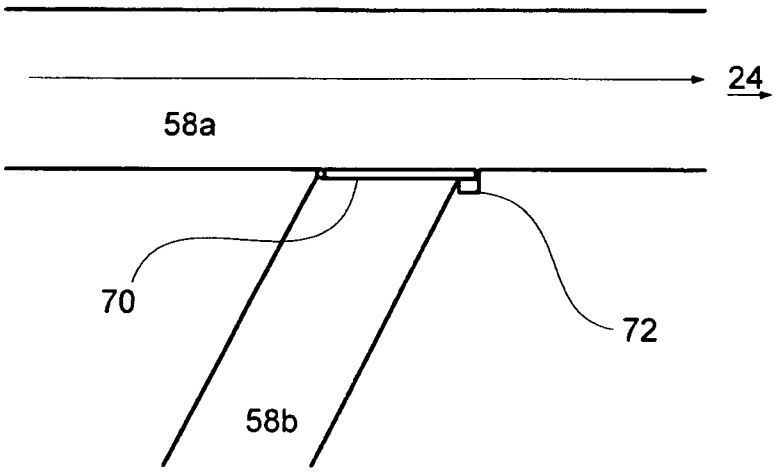

As an alternative to the rotatable cylinder 64, hinged, sprung flaps 70 as shown in FIGS. 9A and 9B, for example, may be used to cover the auxiliary intake pipes 58*b*. The flap 70 serves to selectively open/close the standard intake pipe 58*a* and auxiliary intake pipe 58*b*, thereby allowing a flow through one or other of those pipes 58*a*, 58*b*. The flap 70 may be held in position (i.e., closing either the standard intake pipe 58*a* or auxiliary intake pipe 58*b*) by a remotely actuated latch (not shown), or by any suitable coupling, such as an electromagnetic coupling 72, the current of which could be reversed to quickly force the flap 70 open. In any event, the coupling must be sufficiently strong that, whilst drawing air through an intake 58*a*, 58*b*, water 12 is not inadvertently drawn through the other intake 58*a*, 58*b*, and vice versa. In many cases, air will be drawn into the propulsion system 24 in preference to water 12 and, in such cases the valving must be sufficiently strong to withstand both the force of water 12 thereagainst and the suction of the propulsion system 24 when drawing in air. In this regard, hermetic seals, butterfly valves, magnetic couplings and other closures for pipes are known, including their control systems and methods for control, and will not be described herein in further detail.

The flap 70 is constructed to substantially conform to the surface of the standard intake pipe 58*a* to which it connects, thereby minimizing flow disturbances during normal use of the propulsion system 24. The flap 70 may also be configured so as to provide efficient flow redirection from the auxiliary intake pipe 58*b* down the standard intake pipe 58*a*, though this is less important as the auxiliary intakes 56 should only rarely be used.

In some craft 10, similar intakes 56 will be provided for air. However, in the present case, the auxiliary intakes 56 are used for both water and air. This is achieved by branching the auxiliary intakes 56 into each of the fuel/air mix and water intakes (not shown) of the propulsion system 24, in a manner similar to that shown in FIGS. 9A and 9B. As small amounts of air passing through the propulsion system 24 will not cause problems with the propulsion system 24, the valve timing (i.e., opening and closing of an electromagnetic valve) when switching an auxiliary inlet 56 from the air inlet to the water inlet of the propulsion system 56 will not be critical. However, passing water into the combustion chamber along with the fuel can cause significant damage to the propulsion system 24. Accordingly, a filter (not shown) can be arranged between the branch from the auxiliary intake 56 and the air/fuel inlet of the propulsion system 24, or valve timing can be adjusted to account for the possibility of water being present in the intake pipe 58, as shown in FIG. 7.

Alternatively, as the event of capsizing should not occur regularly, the craft 10 may not have any auxiliary intakes 56 which supply air to the propulsion system 24. Instead, the craft 10 may be provided with a tank of compressed air (not shown) coupled to the propulsion system 24, which is opened if the craft 10 capsizes. The tank supplies air to be mixed with the fuel in order to run the propulsion system 24. Although the tank may be designed such that it has a specific number of uses, or a specific duration of use at a particular throttle position, it is preferable that the craft 10 be provided with a motor (not shown) that is capable of refilling the tank when the craft 10 is in use. The motor may be separate to the propulsion system 24, but is preferably driven by the propulsion system 24.

In addition, the propulsion system 24 must be supplied with fuel when the craft 10 has capsized. In this case, a standard intake at the bottom of the fuel tank 74 will be insufficient as that intake may be at the highest point of the fuel tank 74 when the craft 10 is in a capsized position. Accordingly, the fuel intake (not shown) from the fuel tank 74 into the propulsion system 24 includes a hose extending into the fuel tank 74, which is provided with a weight at the end. When the craft 10 is operating in either a normal or capsized condition, the weight will draw the hose to the lowest point in the fuel tank 74, thereby allowing fuel to be continuously supplied to the propulsion system 24. The weight may also be substituted for any other appropriate means for providing continuous fuel supply irrespective of tank position.

Figure 10:
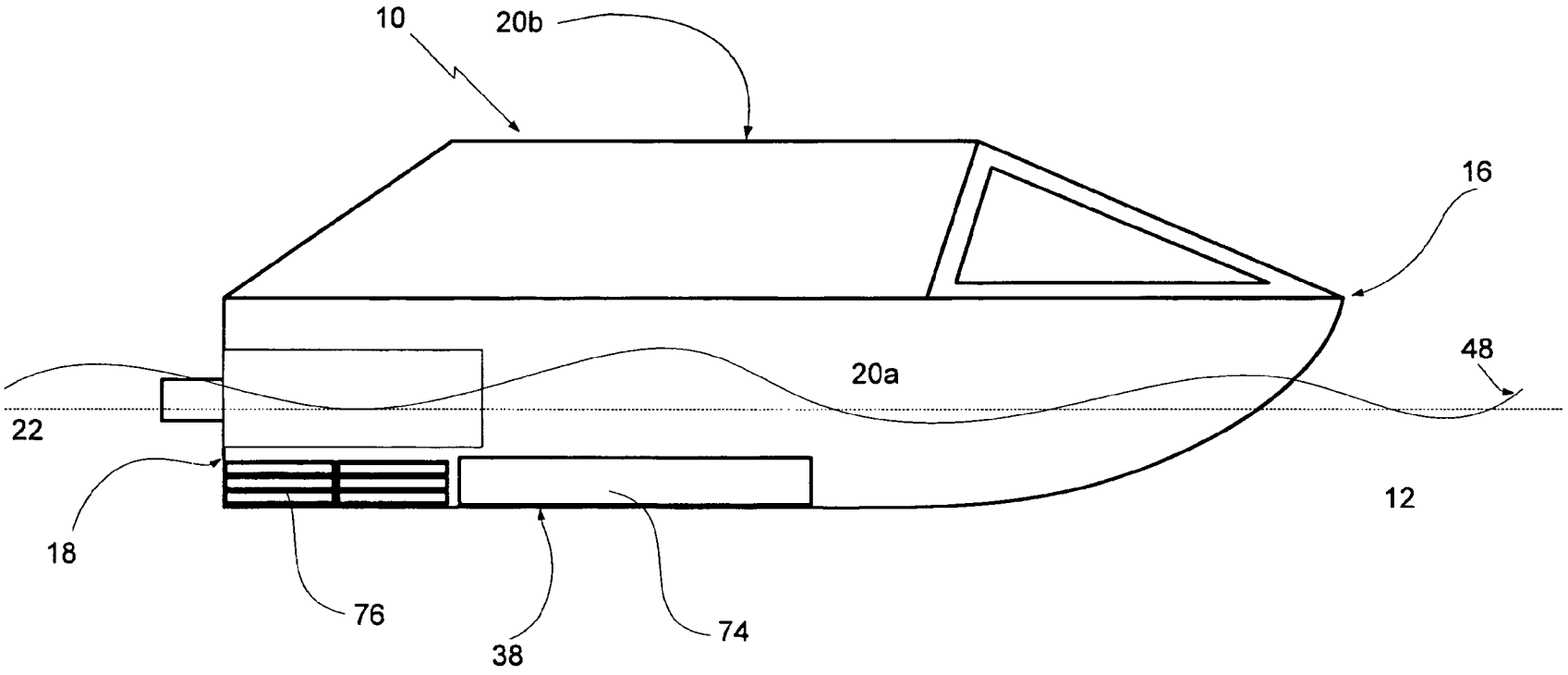
FIG. 10 is a cross-sectional view of a craft.

To ensure the craft 10 is balanced while in motion, it is preferable that its center of gravity be both close to the water 12 and equally distributed across the width of the craft 10—this can be achieved by positioning the fuel tank 74, munitions 76 and other heavy items near the bottom 38 of the craft 10, as shown in FIG. 10A. It is also preferable that the center of gravity be located closer to the rear end 18 of the craft 10 than the front end 16, as this will allow the front end 16 to rise against oncoming waves 48. In contrast, however, it is advantageous if the center of gravity of the craft 10 is off-center with respect to the sides 20*a*, 20*b*, to facilitate rotation of the craft 10 about its axis 22.

Figure 11:
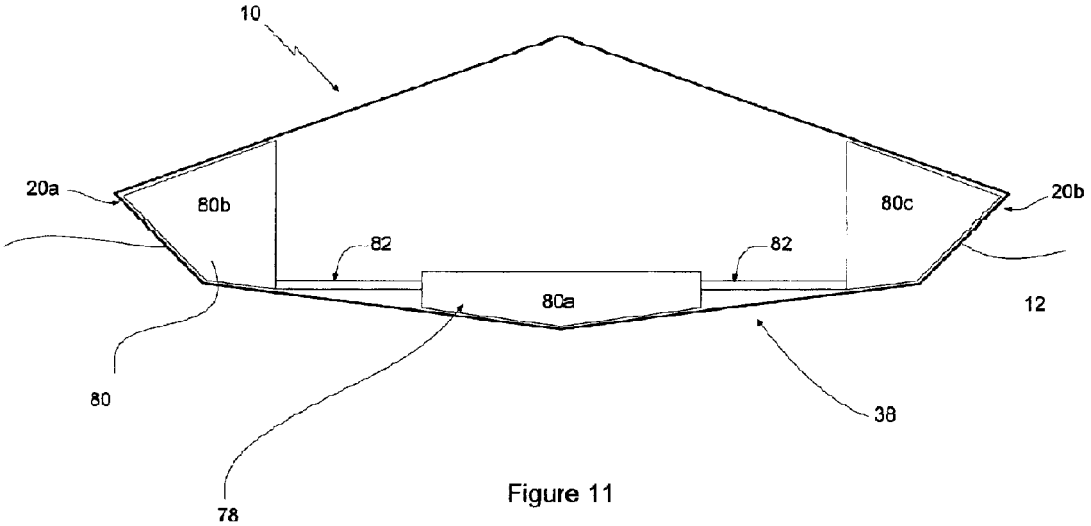
FIG. 11 is a cross-sectional view of a craft, showing a ballast system.

In order to move the center of gravity to an off-center position, the internal volume of the craft 10 includes a ballast system 78, as shown in FIG. 11. The ballast system 78 includes tanks 80 that are able to be at least partially filled to change the position of the center of gravity of the craft 10. The ballast tanks 80 include a bottom ballast tank 80*a*, which when filled draws the center of gravity of the craft 10 towards the bottom 38, and side ballast tanks 80*b*, 80*c*, each of which when filled draws the center of gravity to the side 20*a*, 20*b* on which the respective tank 80*b*, 80*c* is located. The tanks 80 may be secured to the craft 10 by known means and be filled through intakes 82 which can be opened or closed in the same manner as the intake pipes 58 described above. The intakes 82 of the side ballast tanks 80*b* and 80*c* may be in direct fluid communication with the water 12 or, as in the present case, be in fluid communication with the bottom ballast tank 80*a* such that water is drained from the bottom ballast tank 80*a* into the side ballast tanks 80*b*, 80*c*.

The intakes 56 may in some craft contain additional water displacement devices, such as pumps, impellers, propellers or thrusters which can draw water into the main propulsion system should the main propulsions system be unable to draw water from an un-primed pipe. In some embodiments, these displacement devices may take the place of the main water displacement system 24, and be sufficiently strongly powered to direct the water to provide a force about the axis to assist in righting the boat, or rapidly fill the ballasting system.

In some craft, the ballast tanks may additionally be filled, or partially filled by directly opening an orifice that is submerged below the water. The filling, or partial filling of tanks by this method may advantageously, assist in shifting the center of gravity to one side or end of the boat which would more reliably place an intake 54 or 56 in contact with the water to allow for the powered righting system and/or ballast system to be utilized.

Figure 12:
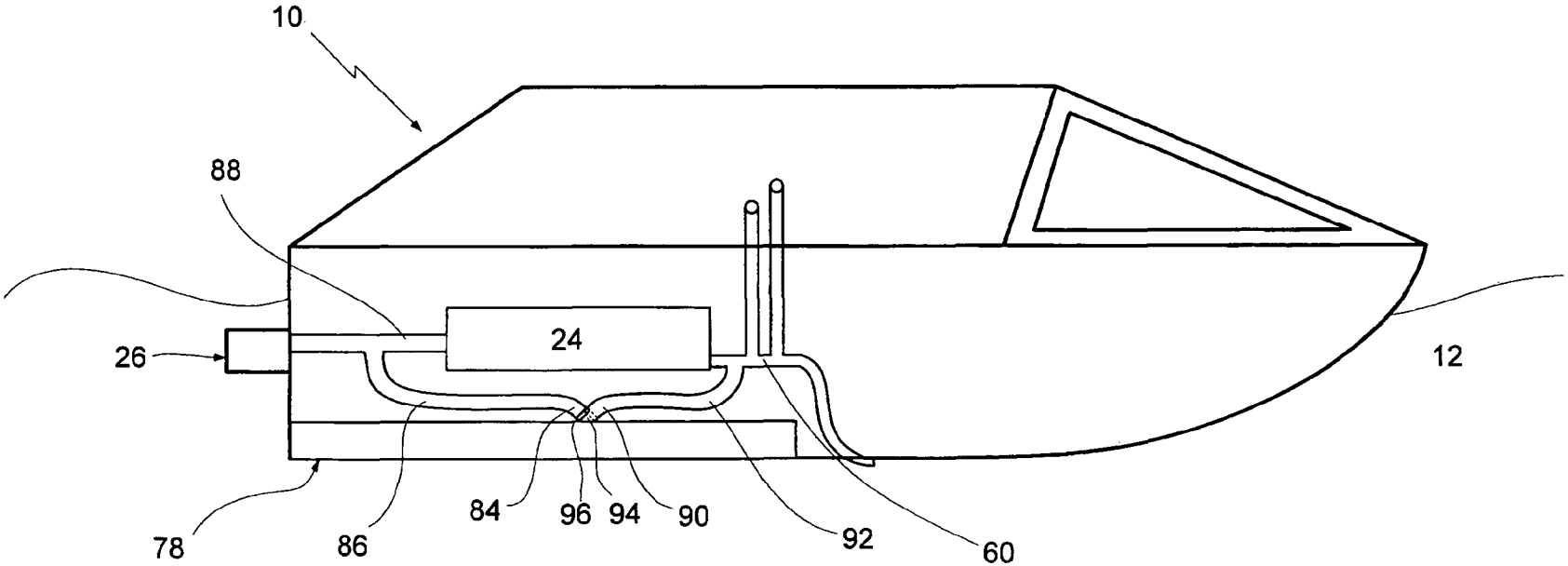
FIG. 12 is a cross-sectional view of the craft of FIG. 11.

The propulsion system 24, as shown in FIG. 12, includes a ballast outlet 84 in at least one of the ballast tanks, for facilitating rapid filling. A ballast pipe 86, which supplies the ballast outlet 84, is connected to the outlet pipe 88 of the propulsion system 24, upstream of the water propulsion system 26, by appropriate valuing. Therefore, when the ballast pipe 86 is connected downstream of the propulsion system 24, water 12 that would otherwise be directed out through the water propulsion system 26 is instead directed into the ballast system 78. In another embodiment of the invention, the water may be directed by means of a pipe, scoop or bucket (not shown) downstream of the water propulsion system 26 into a ballast outlet 84 located near the propulsion system 26 on the outside of the craft.

In addition, the propulsion system 24 includes a ballast inlet 90 in at least one of the ballast tanks 80, to allow rapid evacuation of the ballast system 78. The ballast inlet 90 connects to a ballast inlet pipe 92 which itself is connected to an intake manifold 60, upstream of the propulsion system 24. In the embodiment shown, the ballast inlet pipe 92 and ballast outlet pipe 86 form a common connection pipe 94 which includes a valve 96 for selectively opening and closing each ballast outlet 84 and ballast inlet 90. Advantageously, when water 12 is drawn from the ballast system 78 through the ballast inlet 90, it can be used to propel the craft 10. Furthermore, if the propulsion system includes a ballast inlet 90 in communication with the internal volume of the body 14 of the craft, in the event that the body 14 of the craft 10 is breached (i.e., by collision with a solid body or through penetration from projectiles such as bullets), the ballast inlet 90 may act as a rapid bilge pump to keep the craft 10 afloat and preferably at least partially operational. Alternative inlets 90 and outlets 84 may be provided as appropriate, in accordance with known ballasting systems 78.

The decks of the craft 10 may provide a broad, and generally flat surface in generally coplanar contact with the water 12 when upside-down. As such, the craft 10 would be quite stable, and hence difficult to right in this orientation. The ballasting system 78 is advantageously used to move the boat's 10 central axis away from the plane of the waterline to reduce the amount of torque required to achieve rotation to right the craft 10. By progressively filling the ballast tanks 80*a*, 80*b*, 80*c* from either the rear 18 or the front 16 of the craft 10, or partitioning the ballast tanks 80*a*, 80*b*, 80*c* into generally forward or rear sections one of which would be filled first, the craft 10 comes to have its front 16 or rear 18 end lowered substantially in the water 12, and the other end raised. In doing so, the axis of rotation is brought away from the plane of the water's surface, and the amount of water 12 that must be displaced in order to rotate the craft 10 about its axis to an upright orientation is reduced, and hence reduce the torque required to achieve such a rotation.

To facilitate this, the ballast tanks 80*a*, 80*b*, and 80*c* are filled from the rear 18 of craft 10, by opening a gate or valve (not shown) towards the rear of the tanks 80*a*, 80*b*, 80*c* which is submerged under water 12 when the craft 10 is in an upside-down position. Alternatively, the ballast filling system 78 pumps water into the rear of the tanks 80*a*, 80*b*, 80*c* by positioning the ballast outlet 84 towards the rear of the tanks 80*a*, 80*b*, 80*c*. In some embodiments, both of these methods of filling the tanks 80*a*, 80*b*, 80*c* are enacted in quick succession, or simultaneously.

In another alternative embodiment, the tanks 80*a*, 80*b*, 80*c* are filled from the front 16 of the craft 10 by opening a valve or gate (not shown) submerged when upside-down towards the front 16 of the craft 10, or repositioning the ballast outlet 84 towards the front of the tank.

Advantageously, the ballast tanks 80*a*, 80*b*, 80*c* would be filled in this fashion prior to the water displacement system 23 being engaged to provide a torque about the axis to rotate the craft 10.

Though the body 14 of the craft 10 may be formed from flat panels, the possibility of radar detection, visual sighting or projectile impact (i.e., bullet spray) of the craft 10 can be reduced by reducing the proportion of the craft that visible above surface of the water 12. In this regard, the lower the buoyancy, the greater the proportion of the craft 10 that is submerged and the lower the possibility of radar detection. To lower the buoyancy, the volume of the ballast system 78 may be sufficient such that, when filled with ballast, the mass of the craft 10 is substantially increased thereby lowering the position of the craft 10 in the water 12, in order to substantially reduce the portion of the craft 10 that is visible above the water 12. In emergency situations, such as military exercises, it will be preferable to increase the mass rapidly. Accordingly, in such circumstances, the propulsion system 26 will displace water 12 into the ballast system 78 in order to increase the relative mass of the craft 10 rapidly. Similarly, when it is desired that the craft 10 once again be capable of fast maneuvering, the propulsion system 26 should extract water 12 from the ballast system 78 in preference to water 12 from outside the craft 10.

Figure 13:
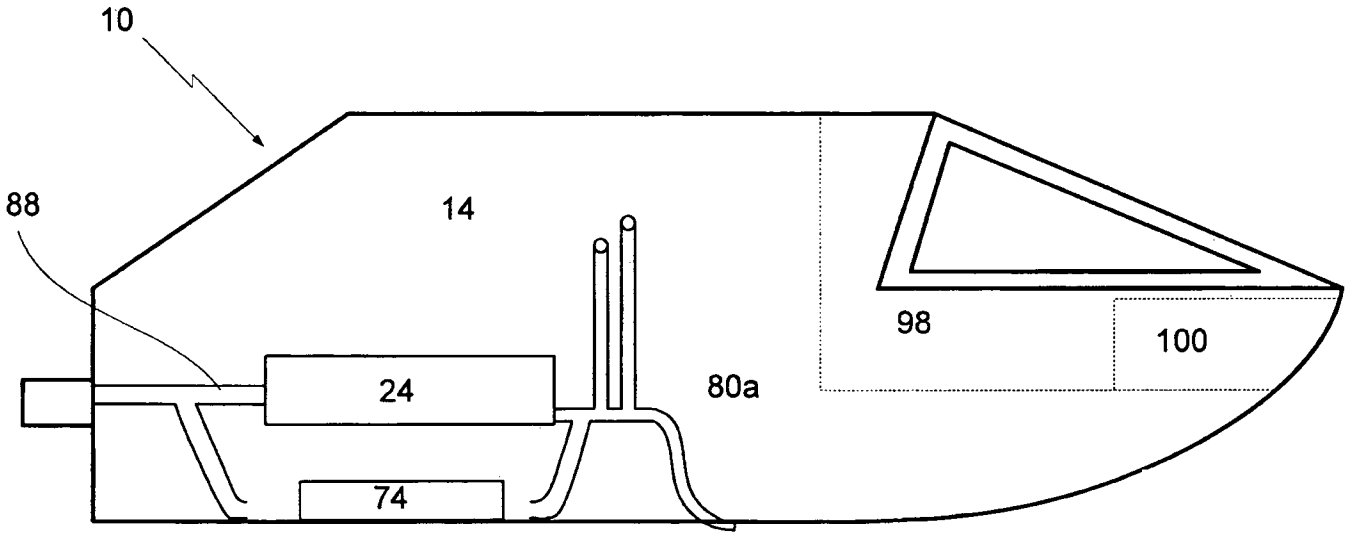
FIG. 13 is a cross-sectional view of a craft partially showing a ballast system.

To ensure low buoyancy, the bottom ballast tank 80*a* may simply be formed from the volume defined between the body 14 of the craft 10 and the proportion of the volume of the craft 10 which must remain dry, for example the cabin 98 and electrical cabinet 100, as shown in FIG. 13. The ballast inlet 90 and ballast outlet 84 are then simply in fluid communication with the internal volume of the craft 10. Similarly, the side ballast tanks 80*b*, 80*c* can be selectively placed into, and out of, fluid communication with the internal volume of the craft 10. The remaining equipment can be water-proofed, consumables vessels such fuel tanks 74 and/or the ballast tanks 80 can be collapsible (i.e., contract around their contents so that air does not occupy any space therein).

Although having been hereinbefore described as being advantageous, the body 14 may not be formed entirely of flat panels but may alternatively be partially, or not at all, formed from flat panels.

The axis 22 about which the craft 10 rotates may shift, relative to the craft, whilst it is righting, and may not necessarily be located down the center of the craft 10. However, as water craft 10 will generally be greater in the length dimension than the width dimension (i.e., longer between the ends 16, 18 than between the sides 20*a*, 20*b*), the axis 22 will usually run along the length of the craft 10 as shown, as it generally requires less effort to rotate a body about the longer dimension.

The water propulsion systems 26*a*, 26*b* may not act in unison but may, instead, be independently operable to cause the craft 10 to rotate about the axis 22. In addition, the water propulsion system 26 may include outlets located at some point intermediate the sides 20*a*, 20*b* of the craft 10 (i.e., near the center of gravity of the craft 10), providing more stable rotation.

Although hydraulic rams 44 have been used in, for example, the control of the position of the trim nozzles 30 or diverters 32, 40 of the propulsion system 24, any suitable position controlling mechanism may be employed. The same applies for any of the other features requiring positional control.

Valves, rotatable cylinders 64 and any other suitable flow controlling mechanisms may be used interchangeably in the applications described herein. In addition, the drive mechanisms for valves, rotatable cylinders 64, hinged, sprung flaps, and other features of the embodiments described herein, may be any suitable mechanism. Electromagnetic couplings 72 may be used though their materials can tend to become corroded, or become unreliable due to disturbances from the water 12. Small motors and mechanically rotatable mechanisms are preferred as many such mechanisms are known, are efficient, and may only require a small aperture to be formed in the pipe 58, 58*a*, 58*b*, 86, 88, 92 in order to receive the shaft about which a larger component, which remains in the pipe 58, 58*a*, 58*b*, 86, 88, 92 (i.e., the disc of a butterfly valve), rotates.

Many combinations, of the features herein described, and modifications to the described embodiments will be apparent to those skilled in the art without departing from the scope of the present invention as hereinbefore described with reference to the accompanying drawings.

Throughout this specification and claims which follow, unless the context requires otherwise, the word "comprise", and variations such as "comprises" and "comprising", will be understood to imply the inclusion of a stated integer or step or group of integers or steps but not the exclusion of any other integer or step or group of integers or steps.

The reference in this specification to any prior publication (or information derived from it), or to any matter which is known, is not, and should not be taken as an acknowledgment or admission or any form of suggestion that that prior publication (or information derived from it) or known matter forms part of the common general knowledge in the field of endeavor to which this specification relates.

PARTS LIST craft 10
water 12
body 14
front end (bow) 16
rear end (stern) 18
sides (of craft) 20*a*, 20*b*
axis (of rotation of craft when righting) 22
water displacement system 23
propulsion system 24
propulsion device 26, 26*a*, 26*b*
displaced water 28
trim nozzle 30
diverters 32
jet outlets 34
jet boat outlet nozzle 36
bottom (of craft) 38
altered diverter 40
top (of craft) 42
hydraulic ram 44
hinge (of diverter) 46
wave 48
trough 50
second hydraulic ram 52
water intakes 54
auxiliary intake 56
intake pipes 58, (standard) 58*a*, (auxiliary) 58*b*
intake manifolds 60
pipe joins 62
rotatable cylinder 64
channels 66*a*, 66*b*
upstream and downstream portions 68*a*, 68*b*
(standard intake pipe) respectively
flap 70
electromagnetic coupling 72
fuel tank 74
munitions 76
ballast system 78
ballast tanks 80, (bottom) 80*a*, (sides) 80*b*, 80*c*
ballast tank intakes 82
ballast outlet 84
ballast outlet pipe 86
outlet pipe 88
ballast inlet 90
ballast inlet pipe 92
common connection pipe 94
valve (common pipe) 96
cabin 98
electrical cabinet 100

The claims defining the invention are as follows:

1. A craft including:

a body having a front end, a rear end, two sides running between said ends, and an axis running generally from the rear end to the front end;

a water displacement system operable to displace water to propel the craft across water, and to displace water to cause the craft to rotate about said axis; and a ballast system, including:

a ballast tank capable of being at least partially filled with ballast to change a position of a center of gravity of the craft to assist in rotation of the craft when capsized; and a rapid filling and emptying system, wherein said rapid filling and emptying system includes:

at least one ballasting intake through which water is passed from the water displacement system into said ballast system; and at least one ballasting outlet through which said water displacement system draws water from the ballast system, wherein water drawn from said ballast system is used to propel the craft.

2. A craft according to claim 1, wherein the water displacement system includes a drive propulsion system for displacing water to propel the craft across water and a rotate propulsion system for displacing water to cause the craft to rotate about said axis.

3. A craft according to claim 2, wherein the rotate propulsion system includes a plurality of water propulsion systems arranged to generate rotation of the craft about the axis.

4. A craft according to claim 3, wherein the water propulsion systems of the rotate propulsion system are located intermediate the ends of the craft.

5. A craft according to claim 1, wherein the water displacement system includes two water propulsion systems through which water is displaced from the craft, each one of said propulsion systems being positioned closer than the other to one of said sides of the craft.

6. A craft according to claim 5, wherein the water propulsion systems are each moveable between a drive position for displacing water to propel the craft across water and a rotate position for displacing water to generate rotation of the craft about said axis.

7. A craft according to claim 6, wherein the water propulsion systems are water jet propulsion systems including jet inlets and jet outlets.

8. A craft according to claim 7, wherein the jet outlets include diverters, and the water propulsion systems are moveable between drive positions and rotate positions by maneuvering the diverters over the jet outlets to redirect flows therefrom.

9. A craft according to claim 7, wherein the water propulsion systems move between said drive positions and said rotate positions by pivoting said jet outlets.

10. A ballast system according to claim 1, wherein the ballast tank includes a bottom ballast tank capable, when in use, of being at least partially filled to draw the center of gravity of the craft towards a bottom of the craft to assist in rotation of the craft when capsized.

11. A ballast system according to claim 10, wherein, when in use, the bottom ballast tank occupies substantially all of the internal volume of the craft.

12. A ballast system according to claim 1, wherein the ballast tank includes a side ballast tank capable, when in use, of being at least partially filled to draw the center of gravity of the craft towards a respective side of the craft to assist in rotation of the craft when capsized.

13. A ballast system according to claim 12, wherein the side ballast tank is in fluid communication with a bottom ballast tank, to allow water from the bottom ballast tank to flow into the side ballast tank.

14. A ballast system according to claim 1, wherein the ballast system is adapted to reduce a torque required to right the craft by filling the ballast tank from one end of the craft only.

15. A ballast system according to claim 14, wherein the ballast tank includes a gate or valve positioned to be submerged under water when the craft is upside down so that, when open, water can fill the ballast tank from said end of the craft.

16. A ballast system according to claim 14, including a pump for pumping water into the ballast tank from said end of the craft.

17. A ballast system according to claim 14, wherein said end is a rear end of the craft.

18. A rapid filling and emptying system according to claim 1, further including a common orifice and a valve, wherein the ballasting outlet and ballasting inlet are configured to be coupled to the ballast system at the common orifice, and the valve is positionable to close one or both of the ballasting inlet and ballasting outlet.

19. A rapid filling and emptying system according to claim 1, being capable of filling the ballast system with sufficient ballast to substantially increase the mass of the craft and thereby lower the position of the craft in water, in order to substantially reduce the portion of the craft visible above water.

20. A craft according to claim 1, wherein the body includes a top and the water displacement system includes at least one auxiliary intake positioned on at least one of the sides and top, through which water can be drawn into the water displacement system.

21. A craft according to claim 20, wherein the at least one auxiliary intake includes a plurality of auxiliary intakes positioned around at least one of the sides and top.

22. A craft according to claim 21, wherein the plurality of auxiliary intakes are positioned around the craft to provide a continuous flow of water to the water displacement system while the craft rotates about the axis.

23. A craft, including:

a body having a front end, a rear end, two sides running between said ends, and an axis running generally from the rear end to the front end; and a water displacement system operable to displace water to propel the craft across water, and to displace water to cause the craft to rotate about said axis, wherein the body includes a top and the water displacement system includes at least one auxiliary intake positioned on at least one of the sides and top, through which water can be drawn into the water displacement system and, wherein the or each auxiliary intake is moveable between an open condition and a closed condition, and includes an intake pipe to which is mounted a sensor for determining whether the flow through the or each auxiliary intake is sufficient to warrant the or each auxiliary intake to remain in the open condition.

24. A craft according to claim 23, wherein the or each sensor is a laser for determining the optical density of the water in the pipe of the or each auxiliary intake.

* * * * *